US005979851A

United States Patent [19]

Purdy

[11] Patent Number: 5,979,851

[45] Date of Patent: Nov. 9, 1999

[54] BELT BUDDY

[76] Inventor: Edward G. Purdy, 49 Pleasant St., Cohasset, Mass. 02025

[21] Appl. No.: 08/908,796

[22] Filed: Aug. 8, 1997

Related U.S. Application Data

[60] Provisional application No. 60/023,710, Aug. 8, 1996.

[51] Int. Cl.[6] ..... A47H 1/10

[52] U.S. Cl. ..... 248/317; 224/250

[58] Field of Search ..... 248/51, 60, 205.2; 224/200, 250, 901.4, 911, 930

[56] References Cited

U.S. PATENT DOCUMENTS

| | | | |
|---|---|---|---|
| 494,123 | 3/1893 | Comins | 224/200 |
| 2,388,811 | 11/1945 | Zatko | 224/250 |
| 3,096,010 | 7/1963 | Rasmussen | 224/250 |
| 3,275,205 | 9/1966 | Howd et al. | 224/250 |
| 3,307,754 | 3/1967 | Anketell | 224/197 |
| 3,372,439 | 3/1968 | Schmid | 248/60 |
| 3,809,349 | 5/1974 | Baedke | 248/51 |
| 4,157,166 | 6/1979 | Voelker | 248/317 |
| 4,417,710 | 11/1983 | Adair | 248/51 |
| 4,470,528 | 9/1984 | Dyess | 224/257 |
| 4,762,257 | 8/1988 | Spillers et al. | 224/663 |
| 4,974,764 | 12/1990 | Cantwell | 224/930 |
| 5,104,076 | 4/1992 | Goodall, Jr. | 248/205.2 |
| 5,119,979 | 6/1992 | Kallman | 224/250 |
| 5,246,154 | 9/1993 | Adams et al. | 224/257 |
| 5,564,610 | 10/1996 | Barron | 224/197 |
| 5,664,712 | 9/1997 | Smrt | 224/250 |

*Primary Examiner*—Ramon O. Ramirez
*Assistant Examiner*—Robert Lipcsik
*Attorney, Agent, or Firm*—James Creighton Wray; Meera P. Narasimhan

[57] ABSTRACT

The belt buddy is a body-mountable electric cord carrier for securing power cords close to a user's body. The carrier includes a mounting member, and an adjustable loop extending from the lower end of the mounting member. The mounting member is a plastic or metal hook. A fastener is connected to the lower end of the mounting member and the adjustable loop, which is a single piece of fabric doubled back on itself, is connected to the fastener. The arrangement allows for the adjustable loop to swivel freely around the lower end of the mounting member. The carrier may also be a unitary structure of metal or plastic material.

15 Claims, 1 Drawing Sheet

BELT BUDDY

This application claims the benefit of U.S. Provisional application Ser. No. 60/023,710, filed Aug. 8, 1996.

BACKGROUND OF THE INVENTION

The present invention relates to body-carried devices for securing power cords close to a user's body.

Portable tools, vacuum cleaners and other hand-operated lawn and household equipment generally rely on electric cords for delivering electric current to the tools from wall-mounted sockets. As the operator and the tool move around the work area, the cord becomes entangled with the tool, the workpiece and other objects in the work area, and the operator often loses sight of the path of the cord. Those occurrences result in aggravating delays and may result in the severing of cords. Needs exist for cord holders that prevent the cord from becoming entangled with the tool, the workpiece or the operator.

SUMMARY OF THE INVENTION

The present invention is a body-mountable electric cord carrier for use with manually operated, electrically powered equipment. The carrier includes a mounting member and an adjustable loop extending from a lower end of the mounting member. The mounting member is a plastic or metal hook having a curved upper end with dimensions for securely and comfortably attaching the carrier to a user's belt. The lower end of the mounting member is connected to the adjustable loop by a fastener. The fastener is preferably a ring, or a riveted fastener made of metal or steel. Preferably, the fastener allows the adjustable loop to swivel freely around the lower end of the mounting member. The adjustable loop is a single piece of fabric that is doubled back over itself to form a loop. One end of the fabric is connected to the mounting member by the fastener. With a ring as a fastener, the second, free end of the fabric freely moves through a cavity in the underside of the ring for adjusting the size of the loop. Locking means are provided for arresting movement of the free end, thereby holding the loop at a desired size. Where a rivet is used as a fastener, the strap may be of leather and has multiple holes for receiving the end of the rivet.

The present carrier is easily attached to the waist of the user without requiring the user to undo his belt. Use of the carrier is universal, as no mating means such as hooks, rings or clips need be provided on the user's belt for attaching the carrier to the user's waist. The carrier maintains the path of the cord close to the user's body, thereby preventing the cord from entering the working path of the power tool. The present invention reduces the likelihood of severing electric cords and limits the incidence of injury and frustration associated with tripping and cord tangle.

The present invention is a lightweight, user-friendly device for use in all cord applications, particular in applications involving the use of hand operated electrically-powered tools, such as construction projects, lawn care and house work. The mounting member of the carrier engages an operator's belt or waistband, thereby securing the carrier to the user. Tools having different cords may be interchangeably used without removing the carrier from the user's belt. The power cord is trained through the loop portion of the carrier and connected to the tool. The loop is adjusted for drawing the path of the cord closer to or further from the user's waist. The loop portion swivels with the movement of the user or the power tool, thereby allowing uninhibited movement of the tool and cord.

These and further and other objects and features of the invention are apparent in the disclosure, which includes the above and ongoing written specification, with the claims and the drawings.

DETAILED DESCRIPTION OF THE PREFERRED EMBODIMENTS

Figure 2:
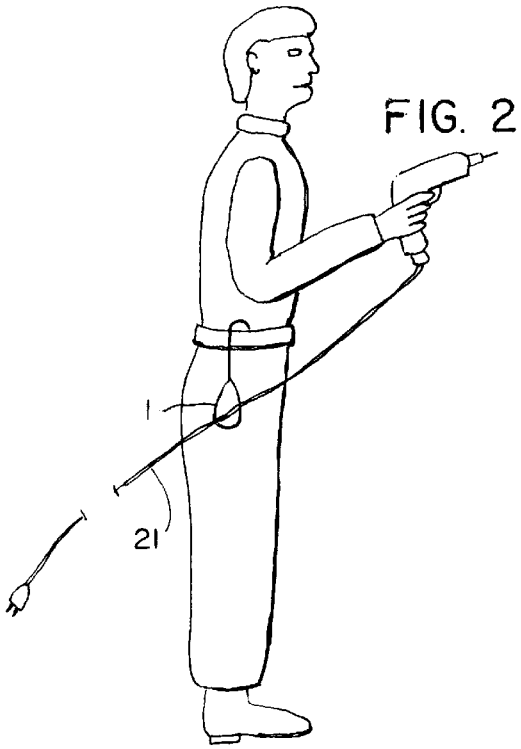
FIG. 2 shows an operator with a cord carrier.
Figure 1:
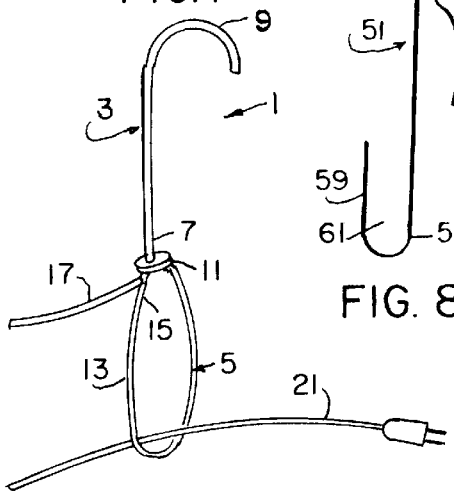
FIG. 1 shows a preferred embodiment of the body-mountable electric cord carrier.

As shown in the drawings, the body-mountable electric cord carrier 1 includes a mounting member 3 and an adjustable loop 5.

The mounting member 3 is preferably made of a first, rigid material. The adjustable loop 5 is preferably made of a second, flexible material. The mounting member 3 includes a lower end 7 connected to the adjustable loop 5 and an upper end 9 for mounting the carrier 1 on the operator's clothing such as a belt or waistband. In preferred embodiments, the upper end 9 is hook-shaped and has dimensions for securely straddling the upper edge of a belt. If the operator is not wearing a belt, the upper end 9 may straddle the waistband of a pair of trousers or shorts. The lower end 7 of the mounting member 3 is connected to the adjustable loop 5 by a fastener 11. The fastener 11 is preferably a riveted fastener made of steel or metal. Preferably, the adjustable loop 5 is pivotally connected to the lower end 7 of the mounting member 3.

In preferred embodiments of the present invention, the mounting member 3 is a one-piece structure made of plastic or metal. The upper end 9 of the mounting member 3 is preferably a hook. Any other acceptable means for attaching the carrier 1 to a belt or piece of clothing, such as a loop or a clip, may be provided as the upper end 9 of the mounting member 3. The attaching means should not, however, rely on the presence of a ring or other mating piece positioned on the belt or clothing for securing the carrier 1 to the operator.

The adjustable loop 5 is preferably a one-piece strap 13 made of Velcro fasteners, leather or other flexible, light-weight material. As shown in the figure, the strap 13 preferably includes a single piece of fabric doubled back over itself to form a cord-receiving loop. A first end 15 of the strap 13 is permanently connected to the lower end 7 of the mounting member 3 by the fastener 11. A second end 17 of the strap 13 is movably connected to the fastener 11. For example, the underside of the fastener 11 may be provided with a ring or loop through which the second end 17 of the strap 13 passes. The size of the loop defined by the strap 13 is adjusted by pulling or releasing the second end 17 of the strap 13. Preferably, the second end 17 of the strap 13 has miniature multiple hook and loop fasteners such as Velcro fasteners, for mating with complementary surfaces near the first end 15 of the strap 13. That attachment means prevents inadvertent adjustment of the size of the loop. Alternatively, other locking means, such as a clip associated with the fastener 11, is included for preventing sliding of the second end through the fastener 11.

As shown in FIG. 2, an operator trains a cord 21 through the loop defined by the strap 13. The cord 21 is pulled close to the operator's body by pulling the second end 17 of the strap 13 through the fastener 11. By securing the cord 21 close to the operator's waist, improved cord control is realized and the risks associated with electric cord use, such as shock, tripping and severing, are eliminated. The cord 21 freely travels through the adjustable loop 5 without pulling the carrier 1 from the user's waist.

Figure 3:
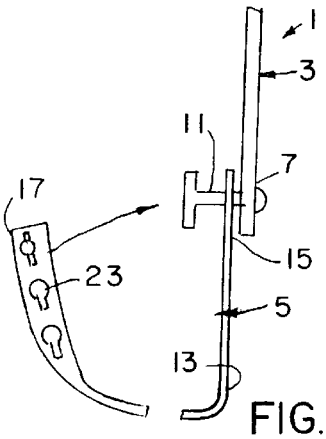
FIG. 3 shows one embodiment of the carrier having an adjustable loop that includes a leather strap having apertures for receiving a riveted fastener.

FIG. 3 shows a preferred embodiment of the present carrier 1 having a mounting member 3, a riveted fastener 11 and a strap 13, preferably made of leather. The strap 13 includes multiple holes 23 for receiving the end of the riveted fastener 11. By providing multiple holes 23, the strap 13 is rendered easily adjustable.

Figure 4:
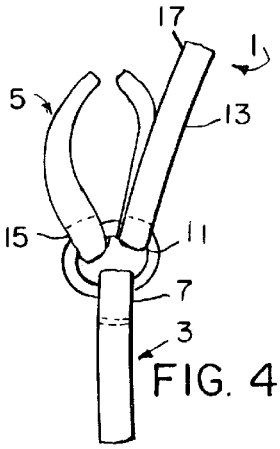
FIG. 4 shows another embodiment of the present carrier having a ring as a fastener.

FIG. 4 shows another preferred embodiment of the present carrier 1 having a ring as the fastener 11. The second end of the strap passes through the cavity of the ring and is folded back on itself thus enclosing the ring and is firmly secured by means of multiple miniature hook and loop fasteners as illustrated in FIG. 5.

Figure 5:
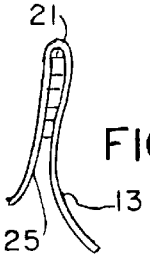
FIG. 5 shows a detail of a miniature hook and loop adjustable fastener on the carrier strap.

FIG. 5 shows a detail of a miniature hook and loop adjustable fastener 25 on the carrier strap 13.

Preferred embodiments of the present invention are about 4 and ½ inches in length and lightweight.

Figure 6:
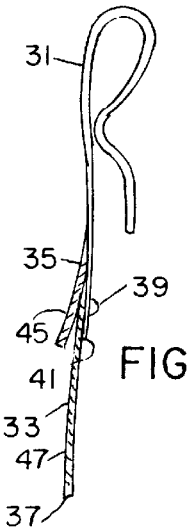
FIG. 6 shows a side elevation of another preferred embodiment of the invention.

FIG. 6 shows in a side elevation of another preferred embodiment, a belt attachment 31 having an adjustable fastener 33 at its lower end. Belt attachment 31 has a clip shape for sliding on a belt or the like. Fastener 33 has upper/proximal end 35 and lower or distal end 37. The upper end 35 is attached to an end 41 of the attachment 31 by any means, such as rivets 39. The upper end 35 of the fastener may be an integral piece or a separate piece from the lower end 37. Velcro type hook 45 and loop 47 attachments are preferably provided (interchangeably) respectively on the upper and lower ends 35, 37 of the fastener 33.

Figure 7:
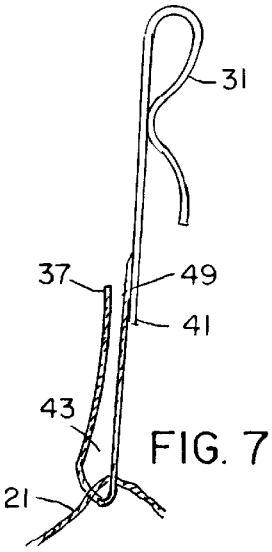
FIG. 7 shows the loop formed of the lower end of the carrier of FIG. 6.

As seen in FIG. 7 a loop 43 is formed by attaching the distal end 37 to the proximal end 35 after passing the fastener around a cord 21. However, fastener 33 is adhered to the attachment 31 by any known means, such as industrial strength adhesive 49 instead of rivets 39 (FIG. 6).

Figure 8:
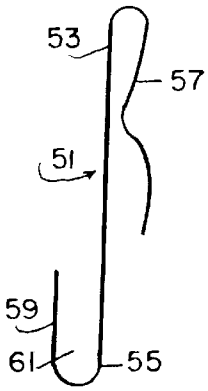
FIG. 8 shows a preferred embodiment of a unitary carrier.

A preferred embodiment shown in FIG. 8 is a unitary/one-piece carrier structure in which the belt attachment 51 has first and second ends 53, 55 respectively. One end, preferably, the one to be attached to a user's body has a hook shaped flange 57 for inserting on a belt or the like. The other end is folded over 59 to form a loop 61 for receiving and holding cords.

Figure 9:
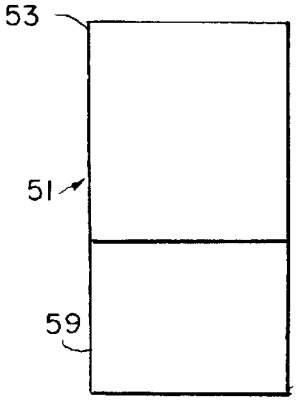
FIG. 9 is a front elevation of a carrier.

FIG. 9 shows a front elevation of a carrier with the attachment 51 and loop forming fold 59.

The carrier of the present invention may be rigid or flexible and is made of any material, such as metal, but preferably plastic. Other material are within the scope of this invention.

While the invention has been described with reference to specific embodiments, modifications and variations of the invention may be constructed without departing from the scope of the invention, which is defined in the following claims.

I claim:

1. A body-mountable electric cord carrier comprising a mounting member having an upper end and a lower end, a belt attachment on the upper end for attaching the upper end to a belt or waistband, and an electric cord holding adjustable loop connected to and extending from the lower end of the mounting member, wherein the mounting member is a hook made of rigid material, having a lower end and a curved upper end with dimensions for securely and comfortably attaching the carrier to a user's belt or waistband, a fastener attached to the lower end of the mounting member, the loop further comprising a strap having first and second ends, the first end of the strap connected to the mounting member and the second end of the strap being connectable to the fastener after looping the strap around an electric cord, whereby an electric cord can be secured to the electric cord carrier while the carrier is attached to the belt or waistband of the user.

2. The apparatus of claim 1, further comprising a fastener connected to the lower end of the mounting member, for allowing the loop to swivel freely around the lower end of the mounting member, and wherein the loop is connected to and extends from the fastener.

3. The apparatus of claim 2, wherein the fastener comprises a ring and wherein the loop is adjustable and comprises a single piece of fabric doubled back over itself, and a first end of the fabric is connected to the ring and a second end of the fabric is adjustably connected to the ring.

4. The apparatus of claim 3, wherein the ring comprises a ring having a cavity in an underside of the ring and wherein the second end of the fabric is movable through the cavity for adjusting the size of the loop.

5. The apparatus of claim 4, wherein the second end of the fabric has multiple miniature hook and loop fasteners for mating a first surface area of the second end with a complementary second surface area of the second end of the fabric, and wherein the second end of the fabric is secured by doubling the second end over to enclose a section of the ring and the first surface area secures to the second surface area.

6. The apparatus of claim 4, wherein the ring further comprises a clip for securing the second end of the fabric.

7. The apparatus of claim 2, wherein the fastener comprises a riveted fastener made of metal or steel, and wherein the loop comprises a strap having a first end and a second end and multiple holes for receiving an end of the rivet, for forming the loop by pushing an end of the fastener through a hole at the first end of the strap and pushing the end of the rivet through a hole at the second end of the strap.

8. A method of securing a power cord close to a user's body comprising attaching a mounting member to a belt or waistband, the mounting member having an upper end and a lower end, wherein the mounting member is a hook made of rigid material, having a curved belt attachment upper end with dimensions for securely and comfortably attaching the carrier to a user's belt or waistband, providing a first fastener attached to the lower end of the mounting member, connecting a first end of a strap to a lower end of the mounting member, the strap having, first and second ends, the first end of the strap connected to the mounting member and having a second fastener and the second end of the strap being connectable to the first fastener after looping the strap around a power cord, looping the strap around the power cord, and attaching the second end of the strap to the fastener at the lower end of the mounting member, whereby a power cord can be secured close to the user's body while the mounting member is attached to the belt or waistband of the user.

9. A method of securing a power cord close to a user's body comprising attaching a mounting member to a belt or waistband, the mounting member having an upper end and a lower end, a belt attachment on the upper end for attaching the upper end to a belt or waistband, wherein the mounting member is a hook made of rigid material, having a curved upper end with dimensions for securely and comfortably attaching the carrier to a user's belt or waistband, attaching a fastener to a lower end of the mounting member, connecting a first end of a strap to the fastener, the strap having first and second ends, the first end of the strap connected to the mounting member and the second end of the strap being connectable to the fastener after looping the strap around the power cord, looping the strap around the power cord, adjusting the size of the loop for pulling the power cord close to the user's body, and attaching the second end of the strap to the fastener, whereby the power cord can be secured close to the user's body while the mounting member is attached to the belt or waistband of the user.

10. A method of securing a power cord close to a user's body comprising attaching a mounting member to a belt or waistband, the mounting member having an upper end and a lower end, a belt attachment on the upper end for attaching the upper end to a belt or waistband, wherein the mounting member is a hook made of rigid material, having a curved upper end with dimensions for securely and comfortably attaching the carrier to a user's belt or waistband, attaching a rivet to a lower end of the mounting member, making multiple apertures in a strap, the strap having first and second ends, the first end of the strap connected to the mounting member and the second end of the strap being connectable to the rivet after looping the strap around a power cord, pushing an end of the rivet through an aperture at a first end of the strap, looping the strap around the power cord, adjusting the size of the loop for pulling the power cord close to the user's body, and pushing the end of the rivet through an aperture at a second end of the strap, whereby the power cord can be secured to the power cord carrier while the carrier is attached to the belt or waistband of the user.

11. The apparatus of claim 1, wherein the material is plastic.

12. The apparatus of claim 1, wherein the material is metal.

13. The apparatus of claim 5, wherein the fasteners are hook and loop fasteners.

14. The apparatus of claim 7, wherein the strap is made of a strong and lightweight material.

15. The apparatus of claim 14, wherein the material is leather.

* * * * *